US008454487B2

(12) United States Patent
Lindroth et al.

(10) Patent No.: US 8,454,487 B2
(45) Date of Patent: Jun. 4, 2013

(54) SEPARATION DISC AND SEPARATOR

(75) Inventors: Per-Olof Lindroth, Jarfalla (SE); Johan Bergstrom, Stockholm (SE); Jan Ackalin, Tumba (SE)

(73) Assignee: Alfa Laval Corporate AB, Lund (SE)

( * ) Notice: Subject to any disclaimer, the term of this patent is extended or adjusted under 35 U.S.C. 154(b) by 326 days.

(21) Appl. No.: 12/936,748

(22) PCT Filed: Apr. 7, 2009

(86) PCT No.: PCT/SE2009/050366

§ 371 (c)(1),
(2), (4) Date: Feb. 15, 2011

(87) PCT Pub. No.: WO2009/126104

PCT Pub. Date: Oct. 15, 2009

(65) Prior Publication Data

US 2011/0136649 A1 Jun. 9, 2011

(30) Foreign Application Priority Data

Apr. 8, 2008 (SE) ..... 0800778

(51) Int. Cl.
*B04B 7/14* (2006.01)
*B04B 1/08* (2006.01)

(52) U.S. Cl.
USPC ..... 494/70

(58) Field of Classification Search
USPC ..... 494/64, 67–73
See application file for complete search history.

(56) References Cited

U.S. PATENT DOCUMENTS

| | | | | |
|---|---|---|---|---|
| 920,481 | A * | 5/1909 | Kimball | 494/64 |
| 3,335,946 | A * | 8/1967 | Putterlik | 494/73 |
| 4,142,671 | A * | 3/1979 | Ivin et al. | 494/73 |
| 4,262,841 | A * | 4/1981 | Berber et al. | 494/66 |
| 7,731,772 | B2 * | 6/2010 | Lagerstedt et al. | 55/407 |
| 8,257,240 | B2 * | 9/2012 | Klintenstedt | 494/64 |
| 8,308,626 | B2 * | 11/2012 | Klintenstedt | 494/64 |
| 2006/0100083 | A1 * | 5/2006 | Lagerstedt et al. | 494/70 |
| 2010/0099545 | A1 * | 4/2010 | Klintenstedt | 494/79 |
| 2011/0136649 | A1 * | 6/2011 | Lindroth et al. | 494/74 |
| 2011/0195832 | A1 * | 8/2011 | Rudman et al. | 494/73 |
| 2011/0237417 | A1 * | 9/2011 | Rudman et al. | 494/70 |

FOREIGN PATENT DOCUMENTS

| | | |
|---|---|---|
| GB | 191404028 | 5/1913 |
| SE | 115167 | 10/1945 |
| WO | WO 2010125049 A1 * | 11/2010 |

* cited by examiner

*Primary Examiner* — Charles E Cooley
(74) *Attorney, Agent, or Firm* — MKG, LLC

(57) ABSTRACT

The invention relates to a separation disc and a milk separator comprising a rotor, which separation disc together with other separation discs forms a stack of separation discs rotatable together with the rotor. The separation disc comprises a truncated substantially conical portion and an annular flange element connected to the conical portion at the smallest radius and extends therefrom radially inwards substantially perpendicular to the axis of rotation. The flange element has a radial extent corresponding to at least 10% of the radial extent of the conical portion. The inner radial edge of the flange element includes recesses distributed along the edge and adapted to protrusions on a column connected to the rotor, extending coaxially through the separation discs. The recesses are substantially filled by the protrusions. The radial extent of the recesses corresponds to at least 20% of the radial extent of the flange element.

13 Claims, 3 Drawing Sheets

SEPARATION DISC AND SEPARATOR

FIELD OF THE INVENTION

The present invention relates to a separation disc adapted to being fitted in a milk separator comprising a rotor and to being rotatable together with the rotor about an axis of rotation. The separation disc is adapted to forming, together with other separation discs, a stack of separation discs which when fitted in the rotor are substantially coaxial with the axis of rotation, wherein spacing members are provided to keep adjacent separation discs in the stack at an axial distance from one another so that the separation discs form between them narrow flow gaps for milk which is to be separated during operation of the milk separator by means of centrifugal force. The separation disc comprises a truncated substantially conical portion and a flange element which is connected to the conical portion at the latter's smallest radius and extends therefrom radially inwards substantially perpendicular to the axis of rotation. The separation disc is provided with a hole which surrounds the axis of rotation and which is adapted to form in the stack of separation discs a flow passage which extends axially through the stack of separation discs in order to lead away cream separated from the milk, wherein the flange elements delimit an axial throughflow cross-section for the flow passage for the light phase. The flange element has a radial extent corresponding to at least 10% of the radial extent of the substantially conical portion, and the inner radial edge of the flange element is provided with a number of recesses distributed along the circumference of the edge. The recesses are adapted to protrusions on a column which is connected to the rotor and which extends coaxially through the stack of separation discs so that the recesses and the protrusions provide polar guidance and centering of the separation discs relative to the column and the rotor.

The invention relates also to a milk separator with a rotor which is rotatable about an axis of rotation and adapted to being provided with a number of stacked separation discs which are rotatable with the rotor, the separation discs being disposed substantially coaxially with the axis of rotation and at least a major portion of the stacked separation discs constituting separation discs according to those indicated above.

BACKGROUND

During milk separation, particularly during separation of cold milk (normally at about 2 to 5° C.), the cream separated from the milk may cause problems in the form of obstruction of various flow passages in the separator, and the narrow flow gaps between the separation discs are particularly problematic. Cold cream is of relatively high viscosity and obstructs the flow gaps by adhering to the surfaces of the separation discs and forming accumulations in the flow gaps. Cold cream also has non-Newtonian characteristics such that the viscosity depends on the flow velocity. This means that cold cream has a so-called liquid limit at which its movement ceases completely (the cream stagnates) when the flow velocity or the shear stresses acting upon the cream is/are below a certain value. To remedy this obstruction problem, the cold milk may be heated (or at least not cooled) before separation. In addition to the advantage of the cream not tending to stagnate, it is also relatively easier to separate cream from non-cold milk, making it possible to separate a larger amount of non-cold milk per unit time. However, heating the milk involves extra equipment and access to thermal energy. Heating the milk may also adversely affect its taste.

SE115167 describes a known separator, wherein the separation disc is given a shape without entailing any disadvantage in the form of, for example, stagnation of separated light phase. The separator has a column in the form of a central tube connected to the rotor. The separation disc forms together with other separation discs a stack of separation discs supported by protrusions in the form of wings on the central tube. The separation disc is provided with a hole which surrounds the axis of rotation and which is adapted to forming, in the stack of separation discs, a flow passage which extends axially through the stack of separation discs to lead away light phase separated from the liquid. The inner edge of the flange element thus delimits together with the outer circumference and wings of the central tube an axial throughflow cross-section of the axial flow passage for the light phase. The velocity of the light phase in the axial flow passage within the inner edge of the separation discs depends on the throughflow cross-section of the axial flow passage and the flow through the separator (in other words, the amount of liquid per unit time which is caused to flow through the whole separator). As the cream takes longer to separate from cold milk than from non-cold milk, a relatively smaller flow through the separator is normally required during separation of cold milk as compared with non-cold milk. With the same throughflow cross-section for the light phase, a smaller flow through the separator will result in a lower flow velocity through the flow passage for the light phase. However, a lower flow velocity entails increased risk of stagnation of the cold cream in the flow passage. The flow velocity of the cold cream may be raised by reducing the throughflow cross-section. In the case of the known separation disc, the throughflow cross-section depends on the diameter of the separation disc's hole which surrounds the axis of rotation in combination with the dimensions of the central tube and of the wings disposed thereon. The known separation disc thus has the disadvantage that the throughflow cross-section depends on said combination. A change of velocity can therefore only be achieved if the whole subassembly (central tube with separation discs) is replaced, since the diameter of the holes in the separation discs and the size of the wings on the central tube are mutually dependent.

GB191404028 describes a known separator for separation of cold milk. The separators rotor comprises a number of stacked separation discs adapted to being rotatable with the rotor, wherein adjacent separation discs form between them narrow flow gaps for separation of cold cream from cold milk fed in. The separation disc is provided with a hole which surrounds the axis of rotation and which is adapted to forming in the stack of separation discs a flow passage which extends axially through the stack of separation discs. Each separation disc is provided with a number of holes for the cream to flow through which are distributed on a radius close to the hole which surrounds the axis of rotation. The object of these throughflow holes is for said obstruction to be reduced by the separation disc having a relatively smaller surface to which the cream can adhere than in the case of a separation disc without throughflow holes. However, the throughflow holes also result in reduced strength and rigidity of the separation disc relative to a separation disc without such throughflow holes. During operation of the separator, the centrifugal force generated by rotation will cause stresses on the separation disc. Such stresses may not only deform the separation disc but also cause fatigue damage in the form of cracking in the separation disc, which often occurs at holes in the separation disc, e.g. at said throughflow holes.

SUMMARY OF THE INVENTION

The object of the present invention is to propose for milk separation a separation disc and a separator which totally or partially eliminate the abovementioned disadvantages.

According to the present invention, this is achieved by a separation disc wherein recesses are formed in such a way that the column protrusions fill substantially the whole of the recesses and that the recesses have a radial extent corresponding to at least 20% of the radial extent of the flange element, the column protrusions being adapted to entraining the light phase during operation of the milk separator.

The main significance of the column protrusions filling substantially the whole of the recesses is that the width of the protrusions corresponds to the width of the recesses, thereby providing correct polar guidance and thus avoiding a relative rotational movement or a clearance between the column and the separation discs during rotation of the rotor. The clearance between the width of the protrusions and the width of the recesses should therefore be minimal, but does of course need to be large enough to allow the separation discs to be fitted on the column. In this respect it is not equally important that the radial extent of the protrusions should likewise correspond to the radial extent of the recesses. In other words, the radial clearance between them may be greater without affecting the column's polar guidance of the separation discs.

The invention makes it easy to vary or adapt the throughflow cross-section, and hence the flow velocity through the axial flow passage, by merely altering the diameter of the hole which surrounds the axis of rotation on the separation disc, while keeping the same column with protrusions. The smaller flow through the separator which is required during separation of cold milk results generally in a decrease in the flow velocity through the separator, and in particular (while maintaining the same throughflow cross-section) a reduction in the flow velocity in the throughflow passage for the cream. The flow velocity of the cold separated cream thus risks becoming too low and causing said stagnation. The present invention makes it possible to provide the separated cream with a velocity increase by the separation discs being replaced by ones in which the diameter of the hole which surrounds the axis of rotation is smaller, i.e. by increasing the radial extent of the flange element relative to the radial extent of the substantially conical surface and at the same time increasing the radial extent of the recesses to the radial extent of the annular flange surface. It is thus easy to adapt the throughflow cross-section and hence the flow velocity for the light phase as between separation of non-cold milk and separation of cold milk by merely replacing a stack of separation discs. At the same time, the separation disc has a particularly advantageous configuration which reduces the obstruction problems involved in separation of cold milk. The column protrusions also entrain the cream which flows inwards along the flange element in the horizontal portion of the separation disc, resulting in a lower pressure drop across this portion of the separation disc.

BRIEF DESCRIPTION OF THE DRAWINGS

The invention will now be explained in more detail by describing various embodiments by way of examples with reference to the attached drawings.

DETAILED DESCRIPTION OF VARIOUS EMBODIMENTS

Figure 1:
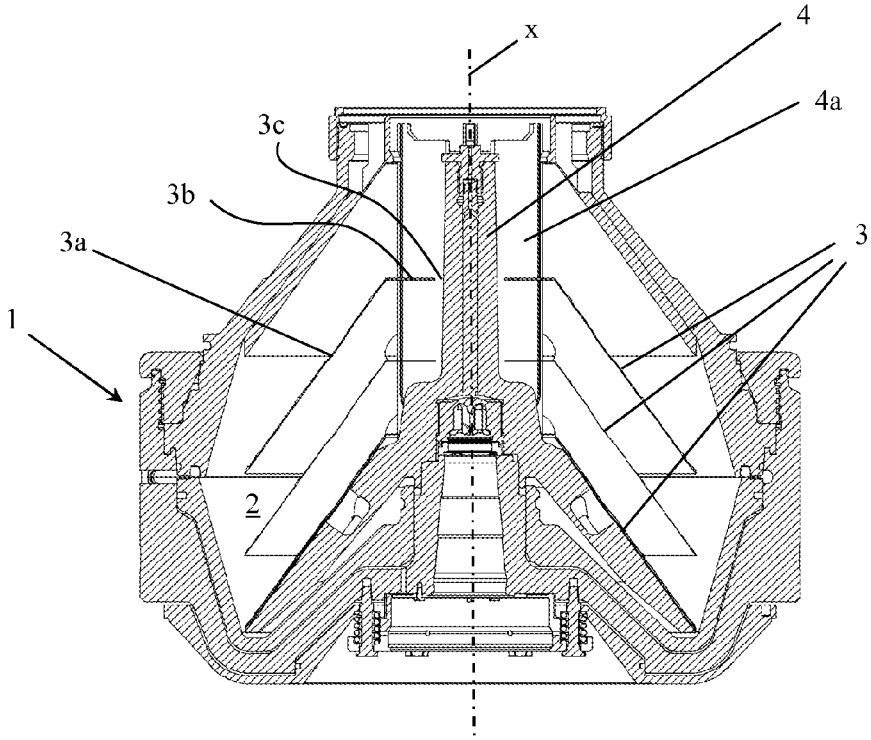
FIG. 1 depicts a vertical section through a rotor belonging to a separator according to an embodiment of the invention.

FIG. 1 depicts a rotor 1 for a separator for separation of cream from milk. The rotor 1 is arranged rotatable around an axis of rotation x and comprises a separating space 2 for the milk which is supplied to the rotor 1 in order to be separated. To this end, the separator is provided with an inlet (not depicted) which extends into the separating space 2 in order to feed in the milk which is to be separated, and at least two outlets (not depicted) for discharging cream and skim milk respectively out from the separating space. The rotor's separating space 2 is adapted to being provided with a number of stacked separation discs 3 which rotate with the rotor 1 about the axis of rotation x. The separation disc 3 comprises a truncated substantially conical portion 3*a* and a flange element 3*b* which is connected to the conical portion at the latter's smallest radius and extends therefrom radially inwards substantially perpendicular to the axis of rotation x. In the embodiment depicted, the flange element 3*b* has a radial extent corresponding to about 35% of the radial extent of the substantially conical portion 3*a*. The separation disc 3 is provided with a hole 3*c* which surrounds the axis of rotation x and which is adapted to forming in the stack of separation discs 3 a flow passage which extends axially through the stack of separation discs 3 in order to lead away cream separated from the milk. The stack of separation discs 3 is arranged substantially coaxially with the axis of rotation x on a column 4 which is connected to the rotor and which extends coaxially through the holes 3*c* which surround the axis of rotation x of the stack of separation discs 3.

Figure 2:
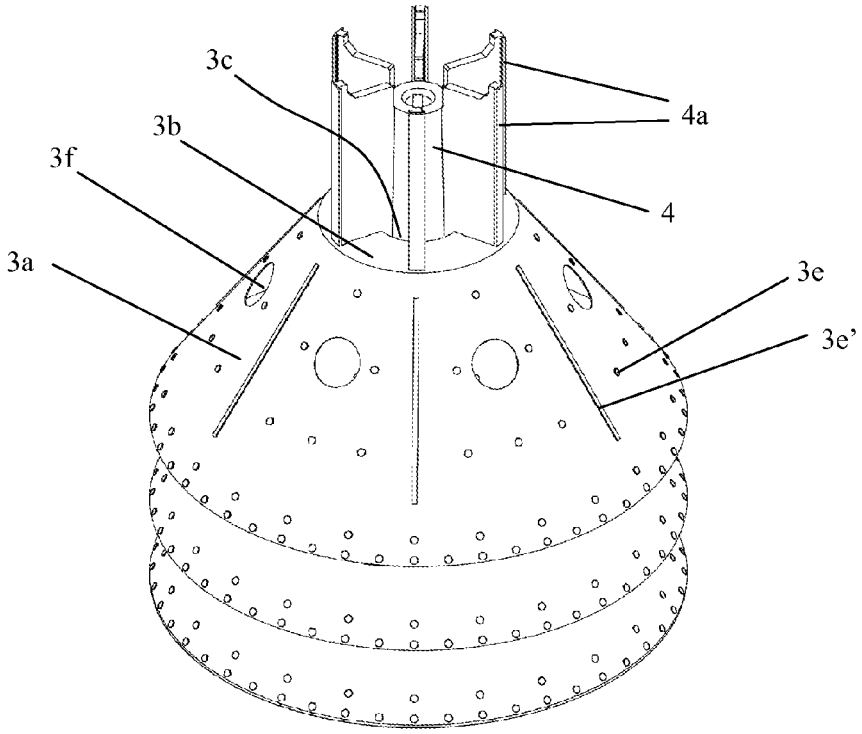
FIG. 2 depicts a view of the column with separation discs in FIG. 1.
Figure 3:
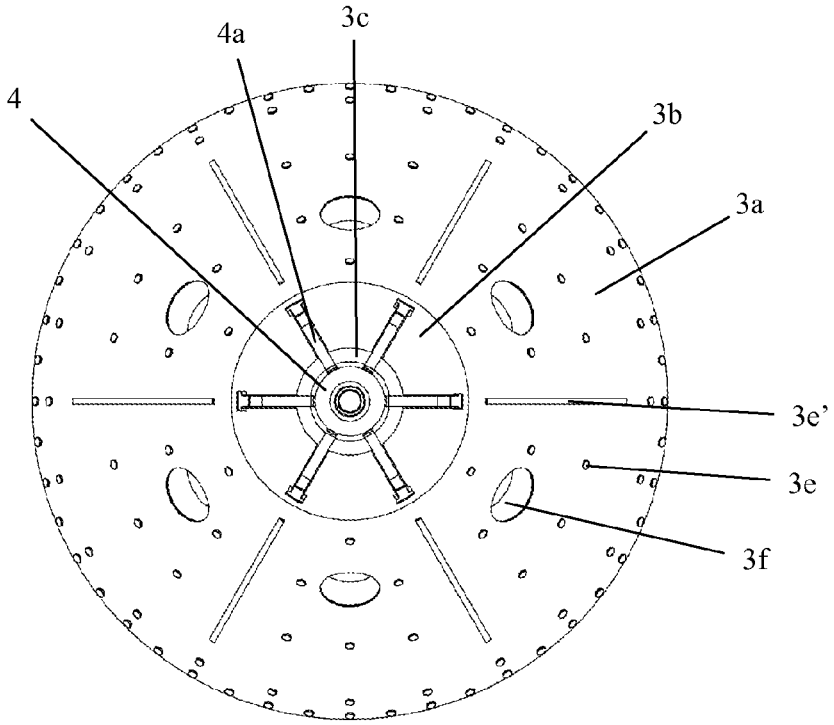
FIG. 3 depicts a view from above of the column with separation discs in FIGS. 1 and 2.

FIGS. 2 and 3 depict a view of the column 4 with the separation discs 3. The column 4 comprises a number of protrusions in the form of so-called wings 4*a* which extend radially out from and axially along the column 4, and the separation discs 3 comprise corresponding recesses 3*d* (see FIG. 4) adapted to the wings 4*a* so that the recesses 3*d* and the wings 4*a* provide polar guidance and centering of the separation discs 3 relative to the column 4 and the rotor 1. The separation disc's holes 3*c* which surround the axis of rotation x form the flow passage which extends axially through the stack of separation discs 3 in order to lead away the cream, while the inner edges of the flange elements 3*b* together with the column's outer circumference and wings delimits an axial throughflow cross-section for the flow passage for the cream.

For the sake of clarity, FIGS. 1 and 2 depict only three separation discs 3 at large mutual spacing, but it should be noted that in reality the separator normally comprises a considerably larger number of stacked separation discs at significantly smaller mutual spacing, i.e. with significantly narrower flow gaps between them. To this end, the separation discs 3 are provided with spacing members 3*e*, 3*e'* adapted to keeping adjacent separation discs in the stack at mutual axial spacing such that the separation discs 3 form between them narrow flow gaps for the milk which is to be separated by centrifugal force during operation of the milk separator. The separation discs are provided with holes 3*f* on the conical portion 3*a* to make it possible, in the stack of separation discs, for the milk to be fed into and distributed in the narrow flow gaps between the separation discs. The spacing members may be spot-shaped 3*e* or elongate 3*e'* separate elements attached to the surface of the separation disc by means of, for example, soldering or welding. In the embodiment depicted, the separation disc comprises a combination of spot-shaped 3*e* and elongate 3*e'* spacing members in the form of elements attached to the separation disc's conical portion 3*a*. The length of the elongate spacing members 3*e'* may of course vary.

Figure 4:
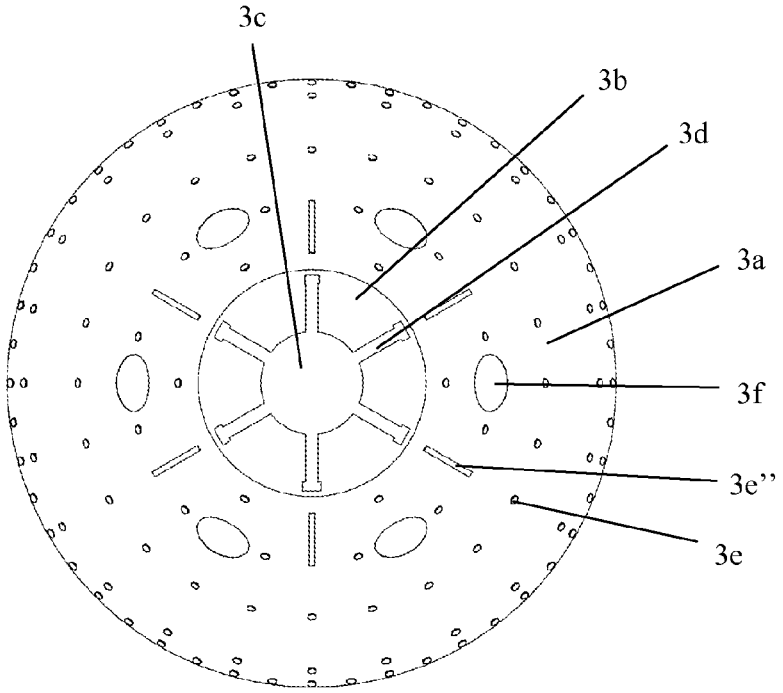
FIG. 4 depicts a view from above of a separation disc according to a second embodiment of the invention.

FIG. 4 depicts a view from above of a single separation disc according to a second embodiment of the invention, in which the elongate spacing members 3*e"* are somewhat shorter than the elongate spacing members 3*e'* on the separation discs in FIGS. 2 and 3. It should be noted that the exact configuration and location of the spacing members on the separation disc may vary. It is for example conceivable for the elongate spacing members to be arranged at an angle to the separation disc's radius along the conical portion of the separation disc and/or for the spacing members to extend along the conical portion in a curved path. The spacing members may also be integral with the separation disc such that the separation disc's material constitutes spacers in the form of local elevations. The flange portion 3*b* of the separation disc 3 might also comprise spot-shaped 3*e* and/or elongate 3*e'*, 3*e"* spacing members. Elongate spacing members 3*e'*, 3*e"* may with advantage be arranged on the flange portion 3*b* if increased entrainment of the liquid is desired in this portion of the flow gap between the separation discs, resulting in a lower pressure drop through this portion of the flow gap.

Figure 5:
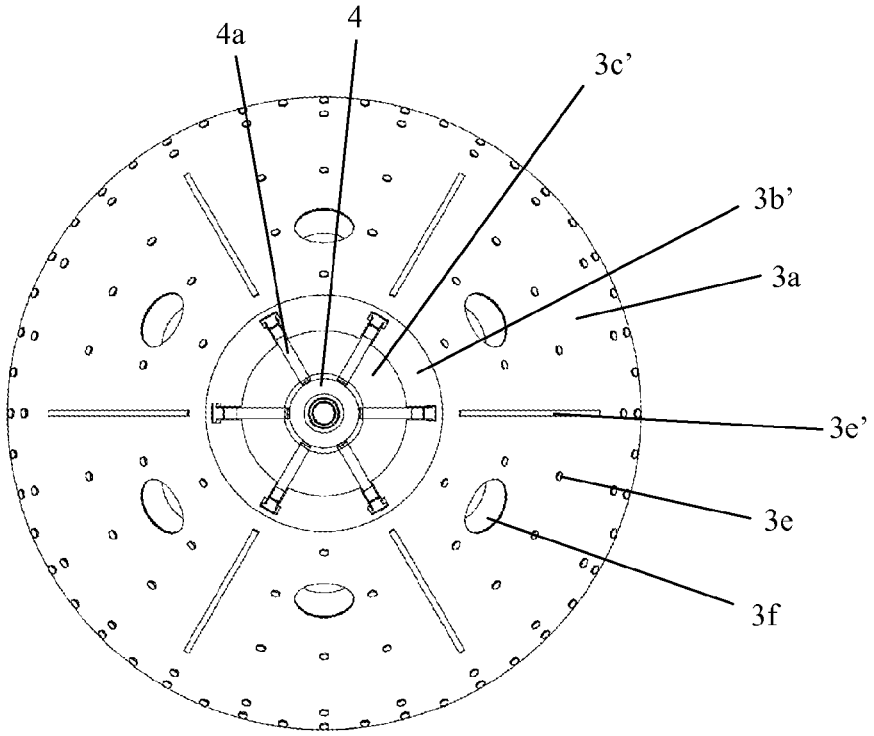
FIG. 5 depicts a view from above of the column with separation discs according to a third embodiment of the invention.

According to a third embodiment of the invention (see FIG. 5), the diameter of the separation disc's hole 3*c'* which surrounds the axis of rotation is larger than in the previous embodiments. The separation disc in FIG. 5 is stacked on the same column 4 with wings 4*a* as the previous separation discs. Relative to the previous embodiments, these separation discs thus comprise somewhat smaller flange elements 3*b'* and recesses 3*d'* (see FIG. 6), the recesses 3*d'* being adapted to the wings 4*a*, so that the recesses 3*d'* and the wings 4*a* provide polar guidance and centering of the separation discs relative to the column 4 and the rotor 1. Changing from separation discs with relatively larger holes 3*c'* according to the third embodiment to separation discs according to the previous embodiments with relatively smaller holes 3*c* (but keeping the same column 4 with wings 4*a*) will reduce the throughflow cross-section for the cream, thereby making it possible to adapt the flow velocity of the cream as between separation of non-cold milk and separation of cold milk. A velocity increase for the cream can thus be achieved by the separation discs being replaced by ones with a smaller diameter for the hole 3*c* which surrounds the axis of rotation, i.e. by increasing the radial extent of the flange element 3*b* relative to the radial extent of the substantially conical surface 3*a* and at the same time increasing the radial extent of the recesses 3*d* by the radial extent of the annular flange element 3*b*. If for example the embodiment of the separation disc depicted in FIG. 5 is used for separation of non-cold milk, the previous embodiments of the separation discs according to FIGS. 1-4 might be used for separation of cold milk. In other respects, all the embodiments of the separation disc have a particularly advantageous configuration which reduces the obstruction problems involved in separation of cold milk.

Figure 6:
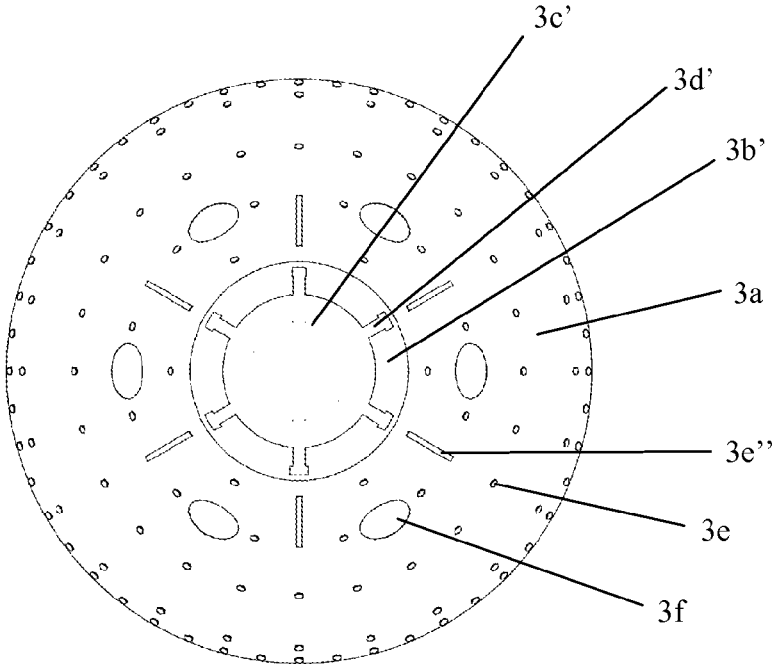
FIG. 6 depicts a view from above of a separation disc according to a fourth embodiment of the invention.

FIG. 6 depicts a view from above of a single separation disc according to a fourth embodiment of the invention, in which the elongate spacing members 3*e"* are somewhat shorter than the elongate spacing members 3*e'* on the separation discs in FIG. 5.

The invention is not limited to the embodiments disclosed but may be varied and modified within the scope of the following claims.

The invention claimed is:

1. A separation disc adapted to being fitted in a milk separator comprising a rotor, to being rotatable together with the rotor about an axis of rotation and to forming together with other separation discs which are fitted in the rotor substantially coaxially with the axis of rotation, wherein spacing members are arranged to keep adjacent separation discs in the stack at mutual axial spacing such that the separation discs form between them narrow flow gaps for milk which is to be separated during operation of the milk separator by means of centrifugal force, the separation disc comprising; a truncated substantially conical portion and an annular flange element which is connected to the conical portion at a smallest radius defined thereby, the annular flange element extends therefrom radially inwards substantially perpendicular to the axis of rotation; the separation disc defines a hole which surrounds the axis of rotation and which forms in the stack of separation discs a flow passage which extends axially through the stack of separation discs to lead away cream separated from the milk; the flange element delimits an axial throughflow cross-section for the flow passage for the cream; the flange element has a radial extent corresponding to at least 10% of the radial extent of the substantially conical portion, and the inner radial edge of the flange element is provided with a number of recesses distributed along the circumference of the edge and adapted to protrusions on a column which is connected to the rotor and which extends coaxially through the stack of separation discs, so that the recesses and the protrusions provide polar guidance and centering for the separation discs relative to the column and the rotor; the recesses are formed so that the protrusions fill substantially the whole of the recesses and that the radial extent of the recesses corresponds to at least 20% of the radial extent of the flange element, the column protrusions being adapted to entraining the cream during operation of the milk separator.

2. A separation disc according to claim 1, wherein the radial extent of the flange element corresponds to at least 15% of the radial extent of the conical portion.

3. A separation disc according to claim 1, wherein the radial extent of the flange element corresponds to 20-50% of the radial extent of the conical portion.

4. A separation disc according to claim 1 wherein the radial extent of the flange element corresponds to about 35% of the radial extent of the substantially conical portion.

5. A separation disc according to claim 1 wherein the flange element is adapted together with the column to delimiting the throughflow cross-section of the flow passage so as to result in a minimum flow velocity for the cream through the flow passage.

6. A separation disc according to claim 1 wherein the recesses are formed so that the protrusions fill substantially the whole of the recesses and that the recesses have a substantial radial extent corresponding to at least 50% of the radial extent of the flange element.

7. A separation disc according to claim 1 wherein the recesses are formed so that the protrusions fill substantially the whole of the recesses and that the recesses have a radial extent corresponding to substantially the whole of the radial extent of the flange element.

8. A separation disc according to claim 1 wherein the flange element comprises spot-shaped spacing members.

9. A separation disc according to claim 1 wherein the flange element comprises linear spacing members which extend radially along a major portion of the radial extent of the flange element.

10. A separation disc according to claim 1 wherein the conical portion has distribution holes adapted to leading and distributing the milk into respective flow gaps in the stack of separation discs during operation of the milk separator.

11. A separation disc according to claim 1 wherein the conical portion is provided with spot-shaped spacing members.

12. A separation disc according to claim 1 wherein the conical portion is provided with linear spacing members.

13. A milk separator comprising a rotor rotatable about an axis of rotation and a plurality of stacked separation discs positioned in and rotatable with the rotor, the separation discs being arranged substantially coaxially with the axis of rotation; a portion of the stacked separation discs being configured as described in claim 1.

* * * * *